United States Patent [19]

Nönnecke

[11] Patent Number: 4,699,599

[45] Date of Patent: Oct. 13, 1987

[54] SHIP'S HULL WITH A CANTILEVERED ELASTIC STERN TUBE ARRANGEMENT FOR THE ELASTIC MOUNTING OF THE TAILSHAFT

[76] Inventor: Ernst Nönnecke, Prof.-Brix-Weg 2, Hamburg, Fed. Rep. of Germany

[21] Appl. No.: 778,382

[22] Filed: Sep. 20, 1985

[30] Foreign Application Priority Data

Sep. 25, 1984 [DE] Fed. Rep. of Germany ..... 3435102

[51] Int. Cl.[4] ..... B63H 23/36

[52] U.S. Cl. ..... 440/112; 440/79; 440/83

[58] Field of Search ..... 440/83, 112, 79, 82; 114/57

[56] References Cited

U.S. PATENT DOCUMENTS 4,344,630 8/1982 Veres ..... 440/112 X

FOREIGN PATENT DOCUMENTS 108710 1/1968 Denmark ..... 114/57
2061851 5/1981 United Kingdom ..... 440/112
704853 12/1979 U.S.S.R. ..... 440/112
839856 6/1981 U.S.S.R. ..... 440/112

*Primary Examiner*—Joseph F. Peters, Jr.
*Assistant Examiner*—Paul E. Salmon
*Attorney, Agent, or Firm*—Toren, McGeady & Associates

[57] ABSTRACT

The ship's hull with a cantilevered elastic stern tube arrangement for the elastic mounting of the tailshaft is extended in aft direction aft of the area of restraint of the stern tube (1) which is surrounded by the extended ship's hull in such a way that a direct coupling is avoided and an influence on its vibrational behaviour excluded so that the aftbody is shifted close towards the propeller 8 resulting in an increased overall propulsive efficiency and thus in an improvement of economy.

5 Claims, 2 Drawing Figures

SHIP'S HULL WITH A CANTILEVERED ELASTIC STERN TUBE ARRANGEMENT FOR THE ELASTIC MOUNTING OF THE TAILSHAFT

BACKGROUND OF THE INVENTION

The invention refers to a ship's hull with a cantilevered elastic stern tube arrangement for the elastic mounting of the tailshaft.

In order to eliminate propeller-induced vibrations of the ship's hull generated by hydrodynamic periodical forces it is known to apply elastic stern tubes, preferably cylindrical or conical and tapering towards the propeller, which surround the tailshaft and include at their aft ends the aft tailshaft bearing and the stern tube sealing.

According to the Patent Specification DE-PS No. 881 313 an elastic tailshaft mounting for vessels is known according to which a vibrating system within the hull is created mainly consisting of the propeller, the tailshaft and its two bearings, in order to minimise the propeller-induced vibrations. In this system the tailshaft and the shaft line are not coupled rigidly, but elastically, whereas the bearings of the tailshaft are not rigidly connected with the ship's hull, but via elastic elements.

According to the Patent Specification DE-PS No. 2 243 897 a cantilevered, double-walled, self-supporting stern tube arrangement for vessels for the elastic mounting of the tailshaft is known which is filled with lubricating oil and its natural vibration lying below excitation. In this arrangement the outer stern tube wall is seated at the thickened ends of the inner stern tube wall and surrounds the inner stern tube at a small distance without intermediate supports and is designed similarly to an airfoil following the flow along the ship's hull with fins tapering in flow direction, where the outer stern tube wall is shorter than the inner stern tube wall and the inner stern tube wall contains the lubricating oil filling and is connected with the outer stern tube wall of the ship's hull by means of screw connections enabling good natural vibration characteristics with a satisfactory section modulus of the clamping section and a relatively low overall weight of the stern tube arrangement. Additionally, the quantity of the lubricating oil required for the lubrication of the aft tailshaft bearing is reduced, because the inner stern tube wall contains the lubricating oil filling so that it is not necessary to fill the entire supporting stern tube up to the stern tube bulkhead with lubricating oil.

It is, however, a common characteristic of all stern tube arrangements that their stern tubes protrude self-supportingly in aft direction as an extension of the hull in way of the tailshaft and that their length normally exceeds the propeller diameter so that a vibrating system is created. The stern tube system is dimensioned in such a way that its natural frequency lies between the number of revolutions of the propeller and the pulse frequency (revolutions × number of blades).

As the self-supporting length of the stern tube is relatively large, the distance between the propeller and the stern frame is relatively large, too. This great distance between the propeller and the stern frame results in a relatively small wake, i.e. the difference between the ship's speed and the velocity of flow into the propeller. It is not possible to increase the wake or to influence it effectively in order to improve the propulsive efficiency or to reduce the engine power, respectively.

SUMMARY OF THE INVENTION

It is the intention of this invention to make use of the advantages of the elastic stern tube arrangement and at the same time to find a way of shifting the stern frame and the aftbody closer towards the propeller and to shape them in such a way that the size and distribution of the wake can be positively affected in order to improve the overall propulsive efficiency and to reduce the engine power or the fuel oil consumption, respectively.

According to the invention, this problem is solved by a ship's hull with a cantilevered elastic stern tube arrangement for the elastic mounting of the tailshaft, which is constructed in such a way, that the hull aft of the area of restraint of the stern tube is extended in aft direction and where the stern tube is surrounded by the extended hull, where a direct coupling is avoided and an influence on the vibrational behaviour of the stern tube is excluded.

Further the elastic stern tube is in way of the tailshaft bearing surrounded by a cylindrical casing tube which is connected with the extended hull area outside of the vibrating system, while the space between the casing tube and the stern tube is closed by means of an elastic sealing in the area facing the propeller.

According to the invention the aftbody surrounding the cantilevered elastic stern tube arrangement is shifted closer towards the propeller so that the stern frame and the aftbody can be shaped in such a way that size and distribution of the wake can be affected positively. Thus the overall propulsive efficiency is improved and the engine power or the fuel oil consumption, respectively, is reduced. It is also possible to install the elastic stern tube mounting in single-screw vessels with high block coefficients and conventional aftbody hull forms, also in ships already in service. Especially at vessels with high block coefficients the hydrodynamic periodical forces at the propeller are often pronounced because of the non-uniform wake distribution. This often leads to vibrations of the aftbody.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
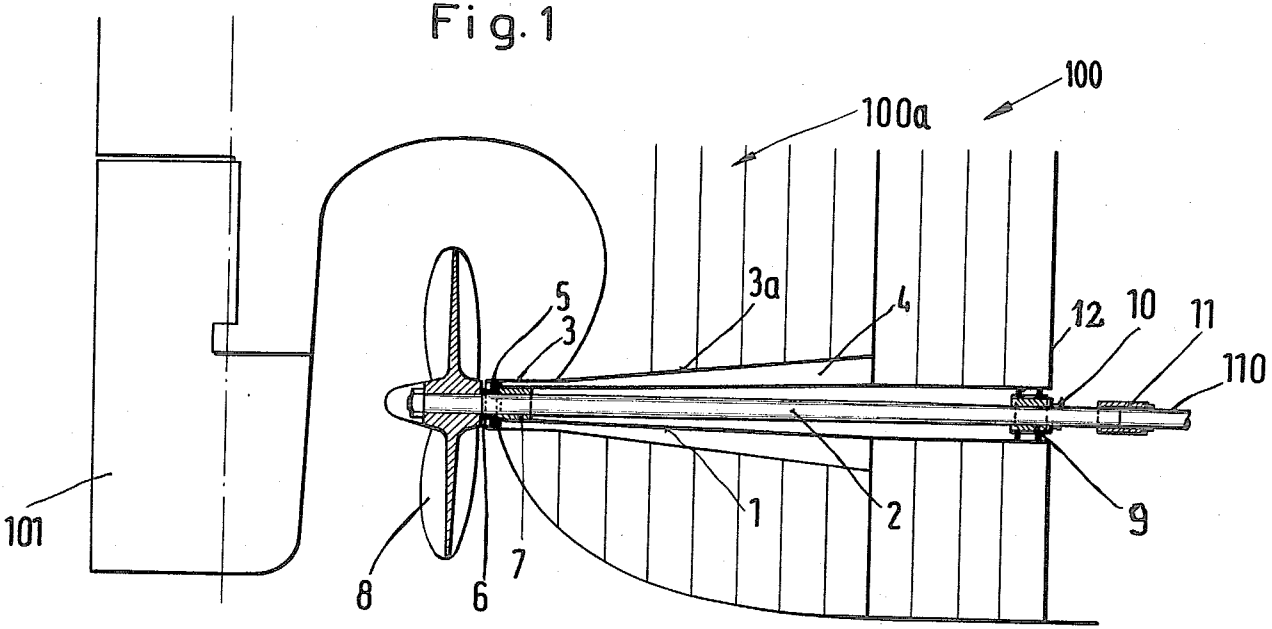
FIG. 1 is a part-sectional view of the aftbody with an inner elastic stern tube system in accordance with the invention. The main hull section is marked 100, the aftbody of the ship's hull is marked 100*a;* and the rudder is marked 101.
Figure 2:
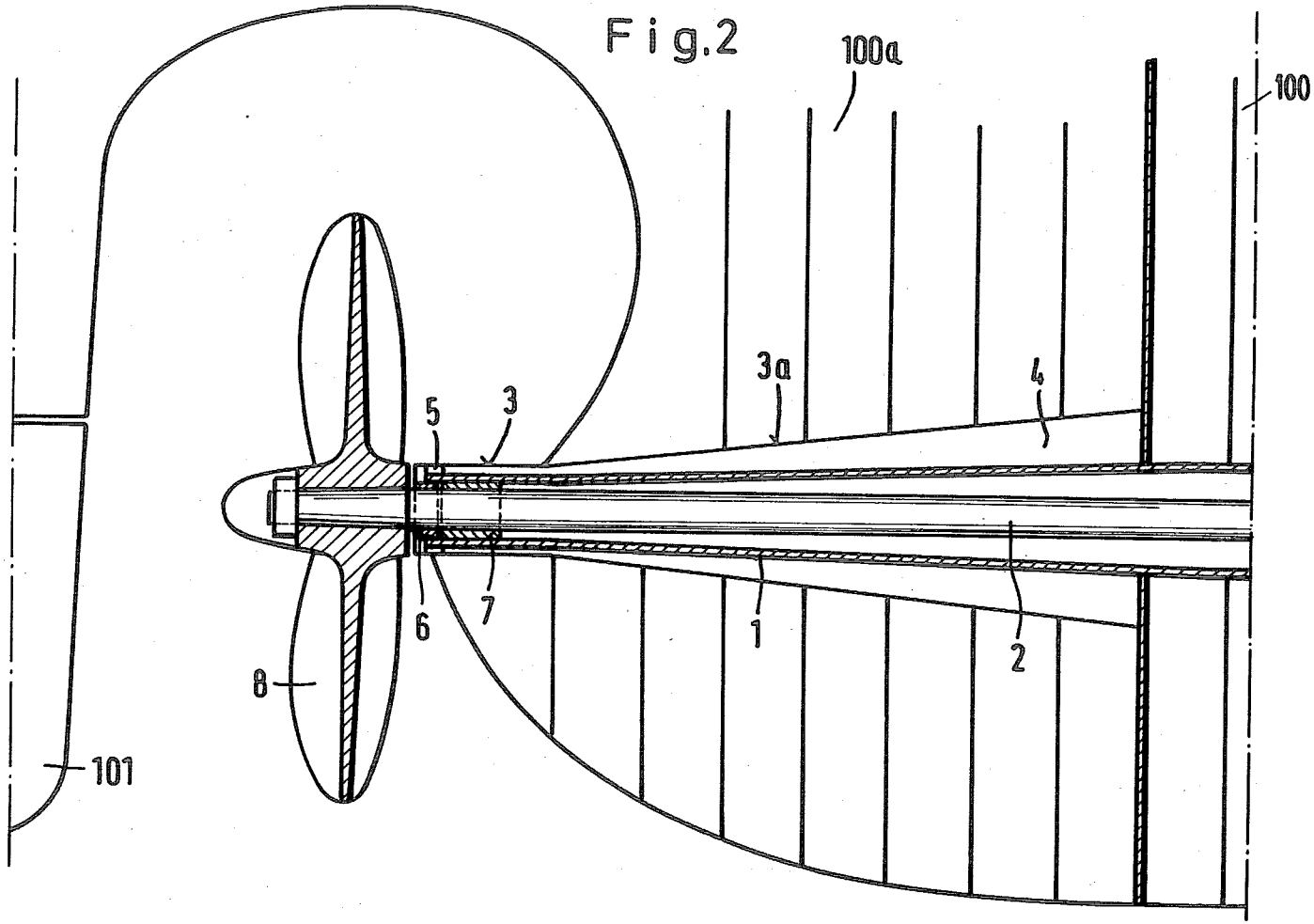
FIG. 2 an enlarged section of a portion of FIG. 1.

The aftbody 100*a* of the hull 100 is extended aft of the area of restraint of the propeller shaft or tailshaft 2 without impairing the performance of the entire system. Preferably a tube 3 is arranged as an outer casing surrounding stern tube 1 which belongs to the surrounding outer aftbody construction as a component part and is not connected with the elastic stern tube 1 so that the stern tube 1 can move freely and the natural frequency of the system is not affected. The stern tube 1 is fixed or restrained in the main hull section 100 but is free of any support between the main hull section and the point where it extends through the aftbody section (100*a*).

The diameter of the elastic stern tube 1 facing the propeller is essentially smaller than the hub diameter of the propeller 8, as it depends on the diameter of the tailshaft 2 mounted in the stern tube 1 and the aft tailshaft bearing 7 of the tailshaft 2. As the elastic stern tube 1 is dimensioned in such a way that its maximum amplitudes at the aft end do not exceed a few mm, even under extreme conditions, the aft end diameter of the outer casing tube 3 surrounding the elastic stern tube 1 can be selected as large as the diameter of conventional stern tubes. For practical reasons this outer casing tube 3 should be preferably designed conically expanding in forward direction forward of the aft tailshaft bearing, i.e. for a better accessibility for welding, arrangements of watertight inspection holes, etc. This conical section of the outer tube 3 is marked 3*a*.

The space 4 between the elastic stern tube 1 and the outer casing tube is closed at its aft end by way of the aft tailshaft bearing 7 with an elastic sealing 5 so that the water cannot penetrate into this space 4. It is, however, possible to fill this space 4 with water without affecting the performance of the system adversely. But the parts of the steel structure adjacent to the space are subject to corrosion in course of time unless corrosion-resistant materials are used in this area.

When arranging an aft elastic sealing 5 between the stern tube and the outer casing tube the space 4 can remain void or be filled with a corrosion-preventing liquid or elastic foam.

Moreover, 6 of the drawing marks the sealing between the tailshaft 2 and the elastic stern tube 1, 9 marks the fore tailshaft bearing of tailshaft 2, 10 a gland seal and 11 the coupling between the tailshaft 2 and the propeller shaft 110.

Based on the configuration of the elastic stern tube system according to the present invention it is possible to apply all different hull forms and appropriate appendages of single-screw vessels improving the wake distribution, i.e. asymmetric aftbody forms, flow straightening nozzles forward of the propeller, stern bulbs, aftbody forms with ice fins and rudder heels. The same principle can correspondingly be applied to catamaran aftbodies or twin-screw vessels with double skegs or with pronounced shaft bossings extended to the propeller.

What is claimed is:

1. In a ship's hull comprising a main hull section (100) and an aftbody section (100*a*) extending aft from said main hull section, an axially elongated tailshaft (2) having a first end and a second end, a propeller (8) mounted on the second end of said tailshaft outwardly from said aftbody section, the first end of said tailshaft located within said main hull section (100) and extending from said main hull section through and out of said aftbody section (100*a*) with the second end of said tailshaft located adjacent said aftbody section, wherein the improvement comprises a support arrangement for said tailshaft and propeller comprising an axially elongated stern tube (1) laterally enclosing and spaced radially outwardly from said tailshaft, said stern tube having a first end and a second end with said first end located within said main hull section spaced from said aftbody section and secured to said main hull section, said stern tube having a first axially extending section located wholly within said main hull section and a second axially extending section located wholly within said aftbody section with said first axially extending section being supported by said main hull section and said second axially-extending section being free of support from said main hull section to the end of said aftbody section spaced from said main hull section and means for only elastically supporting the second end of said stern tube in said aftbody section, said aftbody section laterally encircling and spaced outwardly from said stern tube so that said stern tube is free of support within said aftbody section from said main hull section up to the second end of said stern tube.

2. In a ship's hull comprising a main hull section (100) and an aftbody section (100*a*) extending aft from said main hull section, an axially elongated tailshaft (2) having a first end and a second end, a propeller (8) mounted on the second end of said tailshaft outwardly from said aftbody section, the first end of said tailshaft located within said main hull section (100) and extending from said main hull section through and out of said aftbody section (100*a*) with the second end of said tailshaft located adjacent said aftbody section, wherein the improvement comprises a support arrangement for said tailshaft and propeller comprising an axially elongated stern tube (1) laterally enclosing and spaced radially outwardly from said tailshaft, said stern tube having a first end and a second end with the second end secured to said main hull section, and means elastically supporting the second end of said stern tube in said aftbody section, said aftbody section laterally encircling and spaced outwardly from said stern tube for the axial extent of said stern tube between said main hull section and the second end thereof supported in said shaft body section so that said stern tube is free of support within said aftbody section up to the second end of said stern tube, a tailshaft bearing (7) is located within the second end of said stern tube (1) and supports said tailshaft (2) in said stern tube, said aftbody section includes a casing tube laterally enclosing said stern tube for the axial extent of said stern tube between said main hull section and the second end of said stern tube, and an elastic seal (5) located around the outer surface of said stern tube at the second end thereof and forming a seal between said stern tube and said casing tube.

3. In a ship's hull, as set forth in claim 2, wherein said casing tube includes a cylindrically shaped section extending axially from the second end of said stern tube toward the first end of said stern tube and a conically shaped section extending from said cylindrically shaped section to said main hull section, an axially extending annular space located between the outer surface of said stern tube and the inner surface of said casing tube with said seal (5) forming a closure for the end of said annular space at the second end of said stern tube.

4. In a ship's hull, as set forth in claim 3, wherein said annular space (4) is filled with a corrosion-preventing liquid.

5. In a ship's hull, as set forth in claim 3, wherein said annular space (4) is filled with an elastic foam.

* * * * *